US005134270A

United States Patent [19]

Bragg et al.

[11] Patent Number: 5,134,270

[45] Date of Patent: Jul. 28, 1992

[54] HEATER ASSEMBLY FOR USE IN CLOTHES DRYERS

[75] Inventors: Jackie J. Bragg; Richard D. Graham; Bill Sowder, all of Murfreesboro; Jimmy R. Tate, Woodbury; Robert N. Lewellen, Murfreesboro; Charles E. Bryson, Jr., Murfreesboro; Griva Darwin R., Murfreesboro, all of Tenn.

[73] Assignee: Emerson Electric Co., St. Louis, Mo.

[21] Appl. No.: 774,715

[22] Filed: Oct. 8, 1991

[51] Int. Cl.[5] ..... F24H 3/04; H05B 3/02; F26B 11/04

[52] U.S. Cl. ..... 219/532; 219/536; 219/542; 338/58; 392/379; 34/132

[58] Field of Search ..... 219/532, 536, 537, 542; 338/58; 174/175, 138 J; 392/375, 363, 379, 485; 34/132, 133, 134

[56] References Cited

U.S. PATENT DOCUMENTS 3,670,143 6/1972 Zenz ..... 34/133
4,025,754 5/1977 Marzonie et al. ..... 338/58
4,617,547 10/1986 Howard et al. ..... 338/317
4,628,189 12/1986 Danko ..... 219/532
4,700,495 10/1987 Drews et al. ..... 34/133
4,857,707 8/1989 Dall ..... 219/532

*Primary Examiner*—Bruce A. Reynolds
*Assistant Examiner*—Michael D. Switzer
*Attorney, Agent, or Firm*—Polster, Lieder, Woodruff & Lucchesi

[57] ABSTRACT

A heater assembly (10) is for installation in a clothes dryer (D). The assembly includes at least one open coil heating element (12), and a plurality of insulators (16) to each of which a convolution of the coil is attachable. The insulators are mounted on a support (22) in a spaced relation from each other. The support is attachable to a multi-sided pan structure (30). The pan has sidewalls (32A, 32B) to which the support is attachable for installing the coil in the pan. The pan has a lip (54) which extends beneath one end (54) of a heating unit (U) section (S2). The pan is directly attachable to the unit and the unit directly installable in the dryer. The heater assembly is also formed to help install the unit in the appliance during its manufacture.

10 Claims, 5 Drawing Sheets

HEATER ASSEMBLY FOR USE IN CLOTHES DRYERS

BACKGROUND OF THE INVENTION

This relates to heater assemblies for use in clothes dryers and, more particularly, to an improved heater assembly in which is easier to fabricate and simpler to install.

In the manufacture of clothes dryers for household or commercial use, a heater assembly is usually fabricated by a supplier at his manufacturing site. Completed assemblies are then shipped to the appliance manufacturer where they are installed in the dryer as part of the assembly process. During this installation, the heater assembly is first installed in a mounting fixture and the fixture then installed in the dryer. Heater assemblies comprise coils of open heating wire mounted on insulators which, in turn, are supported on wire rods. A set of electrical terminals are attached to the ends of the wire for insertion in an appropriate receptacle or socket. While a heater assembly is not flimsy, neither is it particularly rugged. As a practical matter therefore, the more a heater assembly is handled, the greater the risk it may become damaged and unusable.

In addition to the above, it is also disadvantageous to have so many parts required for the installation of the heater assembly. Besides the cost of the parts, the more parts there are, the more assembly time is probably required to manufacture an assembly. Added cost factors include enhanced inventories, etc. It thus would be beneficial to eliminate as many parts as possible, particularly if in doing so a way could be found to also make a heater assembly less vulnerable to damage, for example, during shipment and installation.

SUMMARY OF THE INVENTION

Among the several objects of the present invention may be noted the provision of a heater assembly for use in an appliance such as a clothes dryer; the provision of such an assembly which becomes part of a heating unit installed in the appliance rather than simply another part thereof; the provision of such an assembly which is readily interfaced with the heating unit to produce a unit which is readily installable in the appliance; the provision of such a heater assembly to facilitate a heating unit requiring fewer parts than prior units installable in the same type appliance; the provision of such a heater assembly which simplifies assembly of the heating unit prior to installation; the provision of such a heater assembly to use conventional insulator assemblies, or new integral insulator assemblies; the provision of such a heater assembly in which the potential of damage to a heater coil is reduced because handling of the assembly is greatly reduced; and, the provision of such a heater assembly which is designed to conform to a support structure within the appliance to provide an improved fit of the unit within the appliance and reduce potential damage which might occur when the appliance is moved.

In accordance with the invention, generally stated, a heater assembly is for installation in a clothes dryer. The heater assembly includes at least one open coil heating element, and a plurality of insulators to each of which two or three convolutions of the coil are attachable. The insulators are mounted on a support in a spaced relation from each other. The support is attachable to a multi-sided pan structure. The pan has sidewalls to which the support is attachable for installing the coil in the pan. The assembly is directly installable in a heating unit mounted in the dryer and the pan is formed to facilitate this installation. The heater assembly is further formed to facilitate installation of the unit in the dryer so the heater assembly is not damaged or rendered inoperative. The unit is directly installable in the appliance during its manufacture to mount the heater assembly therein. Other objects and features will be in part apparent and in part pointed out hereinafter.

BRIEF DESCRIPTION OF THE DRAWINGS

Corresponding reference characters indicate corresponding parts throughout the drawings.

DESCRIPTION OF PREFERRED EMBODIMENTS

Figure 1:
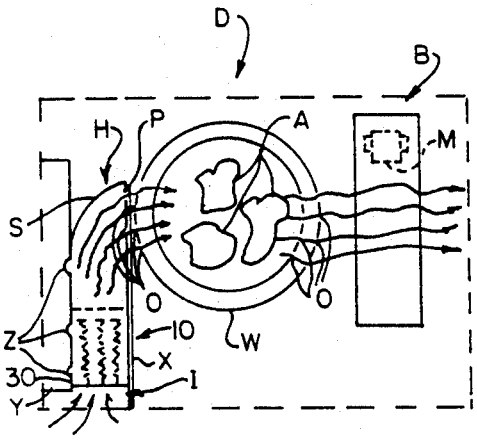
FIG. 1 is a schematic representation of the present invention in use in a clothes dryer.

Referring to the drawings, an appliance such as a clothes dryer is indicated generally D. The dryer has a tub U in which articles A of clothing, towels, or other articles to be dried are placed. A heating unit H is installed in the appliance on one side of the tub, and a blower assembly B on the other side thereof. The heating unit includes a heater assembly 10 of the present invention which is described in more detail hereinafter. Blower B includes a blower motor M by which air is drawn into an air inlet I of the heating unit. This air is heated by heater 10 as it flows through the heater assembly. The air exits the heating unit at its upper end through holes or perforations P formed in the outer shell S of the unit. The heated air is then drawn through the tub and over the articles to dry them, the heated air entering and exiting the tub through openings 0 formed in an outer wall W of the tub. The air is then discharged from the appliance after passing through the blower. As shown in FIG. 1, the heating unit is a vertically oriented unit in which the heater assembly is fitted into the lower end of the unit. The unit is designed to fit between inner and outer supports X and Y respectively. The unit has a flange F (see FIGS. 2 and 3) which abuts against support X and are attachable to it by bolts. The outer support has a series of indentations Z vertically spaced from one another. The outer shell of the heating unit (including heater assembly 10) is contoured to matingly fit in these indentations and insure a snug fit of the heating unit in the appliance.

Figure 2:
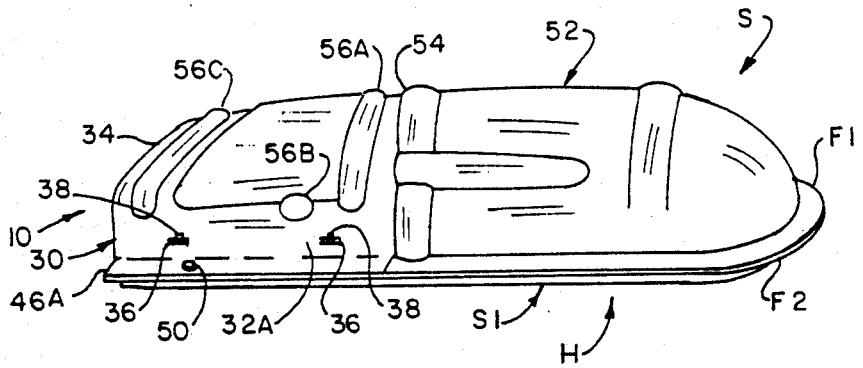
FIG. 2 is a perspective view of an assembled heating unit ready for installation i the clothes dryer.
Figure 3:
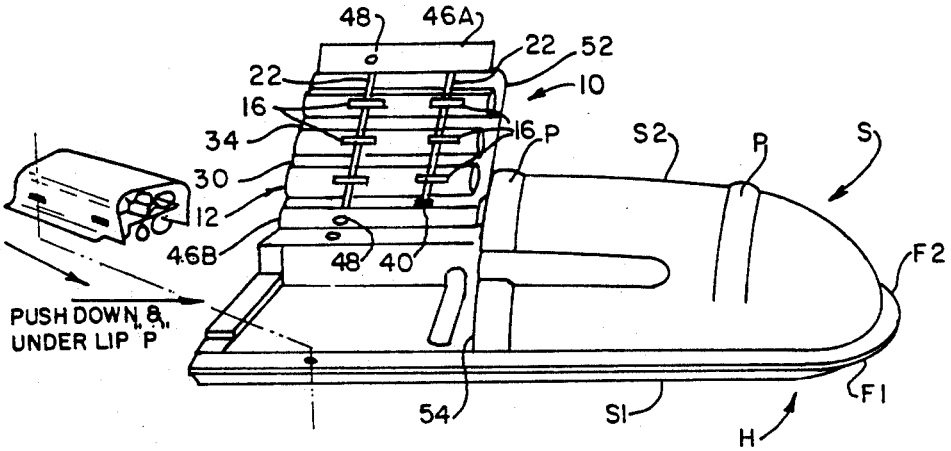
FIG. 3 is a perspective view of the heating unit of FIG. 2 with a heating assembly of the present invention being installed therewith.

Heating unit H is shown in more detail in FIGS. 2 and 3. In FIG. 2, the unit is shown with the heater assembly 10 in place, and in FIG. 3 with the heater assembly positioned for installation prior to installation of the unit in the dryer. The unit has a first shell section S1 and a second shell section S2. When connected together, the upper end of the unit (as viewed in FIG. 1) is a closed end and the other (lower) end is an open end. Section S1 extends the entire length of the unit; while section S2 terminates at a point intermediate the length of the unit. When attached to each other, the sections define a hollow enclosure through which air is drawn. The enclosure is generally rectangular in cross-section with rounded corners corresponding to the curvature of the shell sections. As noted, perforations (not shown) are formed in the upper end of section S1 for heated air to escape the unit into the tub. Section S2 has rounded protruberances P shaped to conform to the indentations X to fit the unit in place in the dryer. The sections also have mating flanges F1 and F2 respectively for joining the sections together.

As noted, heater assembly 10 is connected to the heating unit at the lower end of section S2. Previously, the heating unit required a separate installation of a heater assembly within the unit. This not only complicated the design of the heating unit but also that of the heater assembly. Assembly of the heating unit took longer than is now required with the heater assembly of the present invention, thus increasing the cost of the appliance.

Figure 4:
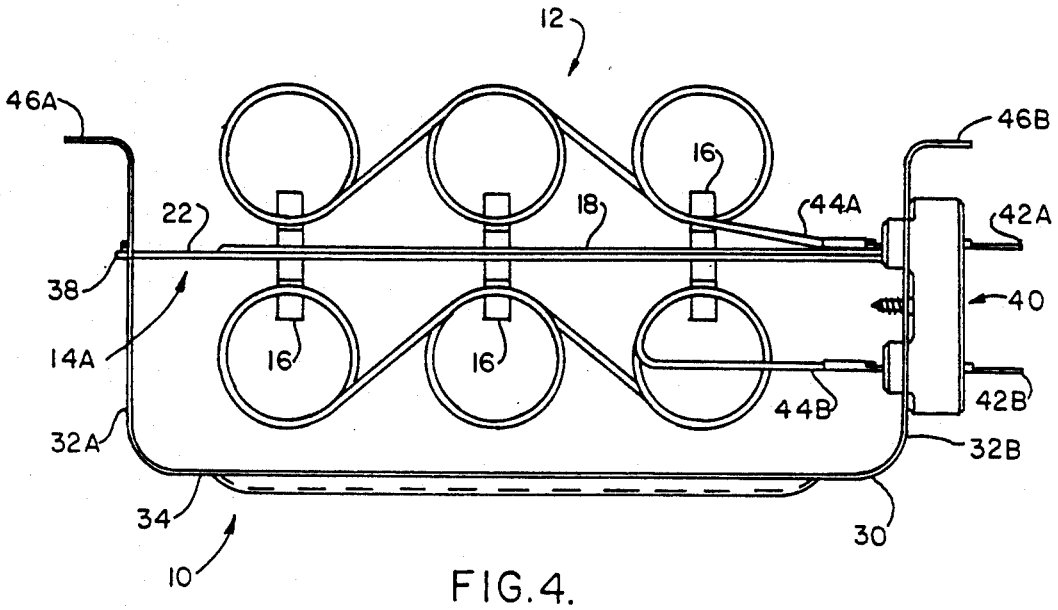
FIG. 4 is an end view of the heater assembly.
Figure 5:
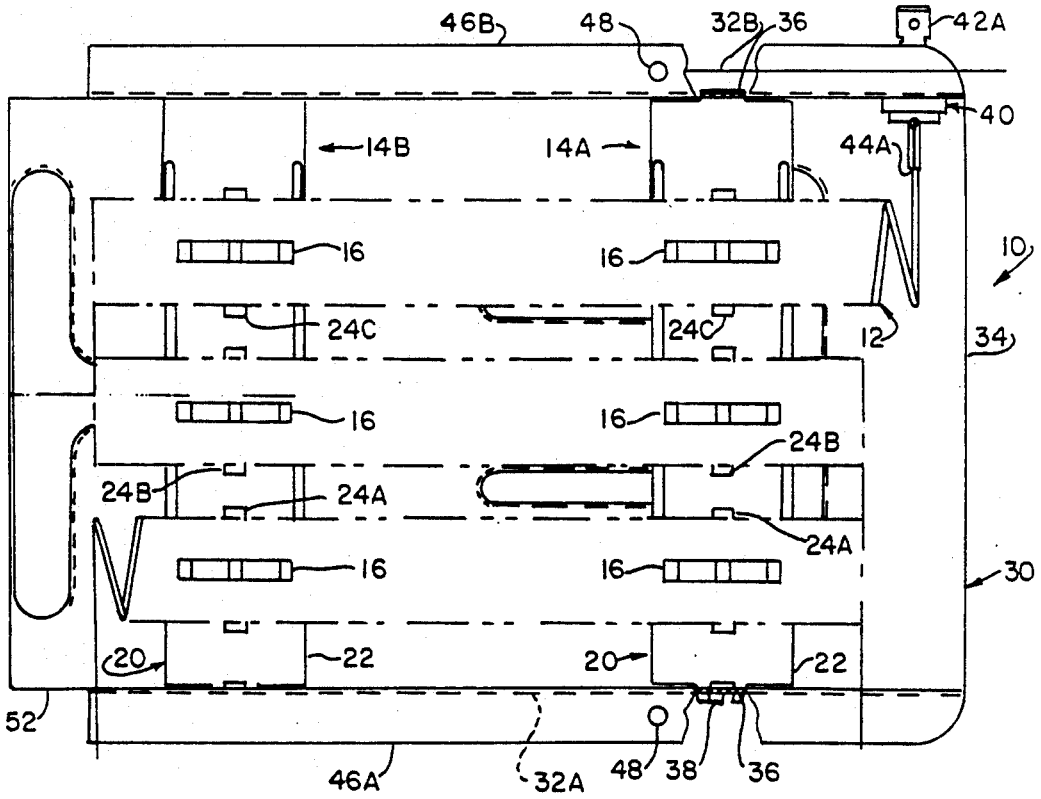
FIG. 5 is a plan view of the heater assembly.
Figure 6:
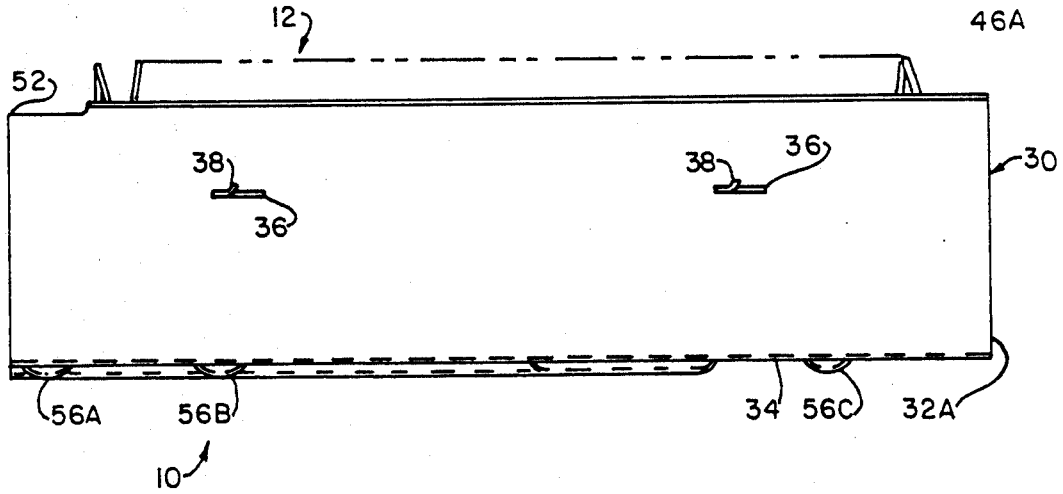
FIG. 6 is a side elevational view of the heater assembly.
Figure 7A:
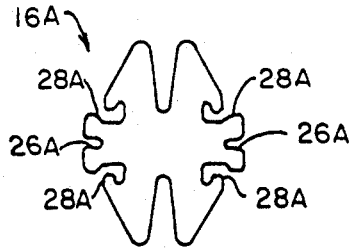
FIG. 7A and FIG. 7B are elevational views of respective insulators used in the heating assembly.
Figure 7B:
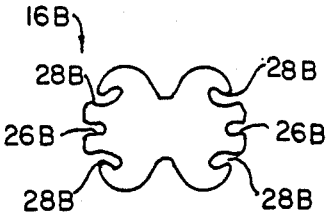
Figure 8:
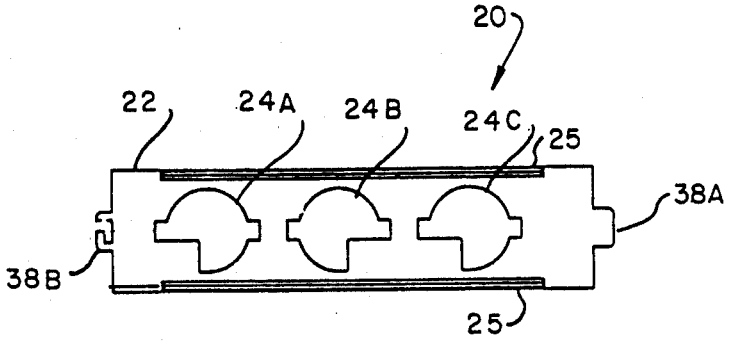
FIG. 8 is a plan view of support on which insulators are mounted.

Referring to FIGS. 4–6, heater assembly 10 is shown in more detail. The assembly first includes an least one open coil heating element 12. The coil is arranged to extend longitudinally of the assembly. An insulator assembly 14 includes a plurality of insulators 16 mounted, in a spaced relationship, on a support member 18. Two insulator assemblies 14A, 14B are shown in the drawings, although it will be understood that more or fewer insulator assemblies could be used. Various types of insulators can be used with the insulator assembly. Shown in FIGS. 7A and 7B are respective insulators 16A and 16B. Shown in FIG. 8 is a support 20 on which the insulators are mounted. Support 20 includes a flat, metal plate 22 in which spaced openings 24A–24C are formed. Further, plate 22 may have stiffener beads 25 extending lengthwise of the support. If present, both of these beads, which are formed in a punching operation can extend in the direction (up or down) or one in each direction. Each insulator has opposed, centrally located slots 26A, 26B respectively. To install an insulator in the support, the insulator is inserted through the opening and the respective slots fitted into the edge of the support adjacent the opening. This is effected by positioning the insulator parallel to the longitudinal axis of the support. Once positioned, the insulators are twisted in the openings until they are orthogonal to the longitudinal axis. This is the position of the insulators shown in FIGS. 4 and 5. The insulators have respective notches 28A, 28B formed on each side of their upper and lower ends. A separate convolution of coil 12 is received in each notch for the insulators to support the upper and lower reaches of the coil as it is installed in the assembly. Again, it will be understood that while coil 12 is shown to have three upper and three lower reaches in the FIGS., the heater assembly could have a different configuration in which the coil has more or fewer reaches. In addition to the insulator assembly described above, heater assembly 10 can also employ an insulator assembly in which the insulators and support are formed of a compatible, fusible material which allows the insulators and support to be fused into an integral assembly. Such an insulator assembly is disclosed in co-pending U.S. Pat. application Ser. No. 07/774,694 which is assigned to the same assignee as the present application.

The insulator assembly is installable in a pan 30. The pan has sidewalls 32A, 32B, and a base 34. The sidewalls have spaced, horizontal slots 36 in which tabs 38 formed at each end of the supports 22 are received. One end of the support having a 95° bent tab is inserted into a slot at an angle, then brought back parallel with the bottom of the pan locking the bent tab and enabling the other differently designed tab to be inserted into the opposite slot. After insertion, this tab is twisted or bent to lock the insulator assembly in place. As seen in FIGS. 4 and 6, coil 12 extends beyond the upper end of the sidewalls. As shown in FIGS. 4 and 5, a terminal block 40 is mounted in sidewall 32B. The block extends vertically of the sidewall and has two terminals 42A, 42B for electrically connecting the heater assembly into a heating circuit of the appliance. The respective ends 44A, 44B of coil 12 are connected to the terminal block to connect coil 12 in the heating circuit.

Pan 30 is generally U-shaped in cross-section. The ends of pan 30 are open, and the heater assembly, when installed, helps define the open end portion of the heating unit. The upper end of each sidewall is outwardly turned to form respective flanges 46A, 46B. These flanges interface with flange F1 of the heating unit when the heater assembly is installed. Each flange has a screwhole 48 which registers with a corresponding screwhole in flange F1. Screws 50 insertable through the screwholes help connect the heater assembly to the heating unit once the heater assembly is installed. It will be noted that the length of the flanges 46A, 46B are less than the length of the pan. The section of the pan along which these flanges do not extend forms a lip 52 which is insertable beneath the back edge 54 of heating unit section S2. To install the heater assembly 10 with the heating unit, heater assembly is positioned as shown in FIG. 3 to the rear of section S2. The heater assembly is held at an angle with respect to the heating unit so lip 52 is beneath the back edge of section S2. Heater assembly 10 is then pushed forward so the lip extends along the inside of the section until the flange portion of the pan sidewalls abut against back edge 54. The screwholes 48 on the flanges should then align with the screwholes in flange Fl and the screws 50 are then inserted to attach the heater assembly to the unit.

It is a feature of the heater assembly that pan 30 be contoured so to faciiitate installation of the heating unit in the appliance. For this purpose, pan 30 has three, parallel, hump shaped protruberances 56A, 56C extend orthogonally to the longitudinal axis of the pan. This humps ar spaced along the length of the pan with hump 56A being at the end of the pan adjacent section S2, hump 56B slightly rearward thereof, and hump 56C adjacent the opposite end of the heater assembly. Each hump begins at one sidewall of the pan, extends along the base of the pan, and terminates at the other sidewall. In addition, a protruberance 58 extends from hump 56A rearwardly of the pan to a point just short of hump 56C.

This protruberance also extends from one sidewall of the pan to the other across the base of the pan. It subsumes the portion of hump 56B which extends across the base of the pan. As previously mentioned, and as shown in FIG. 1, the purpose of the humps is to provide a snug fit of the heating unit into the appliance, wherein the support Y has a corresponding contoured surface into which the humps fit. This makes it difficult to dislodge the installed heating unit either during movement of the appliance from one place to another, or by vibrations which occur during normal use.

What has been disclosed is a heater assembly which becomes an integral part of an installed heating unit. In prior appliance applications, a heater assembly was installed within a heating unit, not as part of it. This construction required more components, took longer to make, and was not as reliable as the heater assembly of the present invention. The disclosed heater assembly further can take advantage of advances in insulator assembly construction to further increase its reliability.

Figure 9:
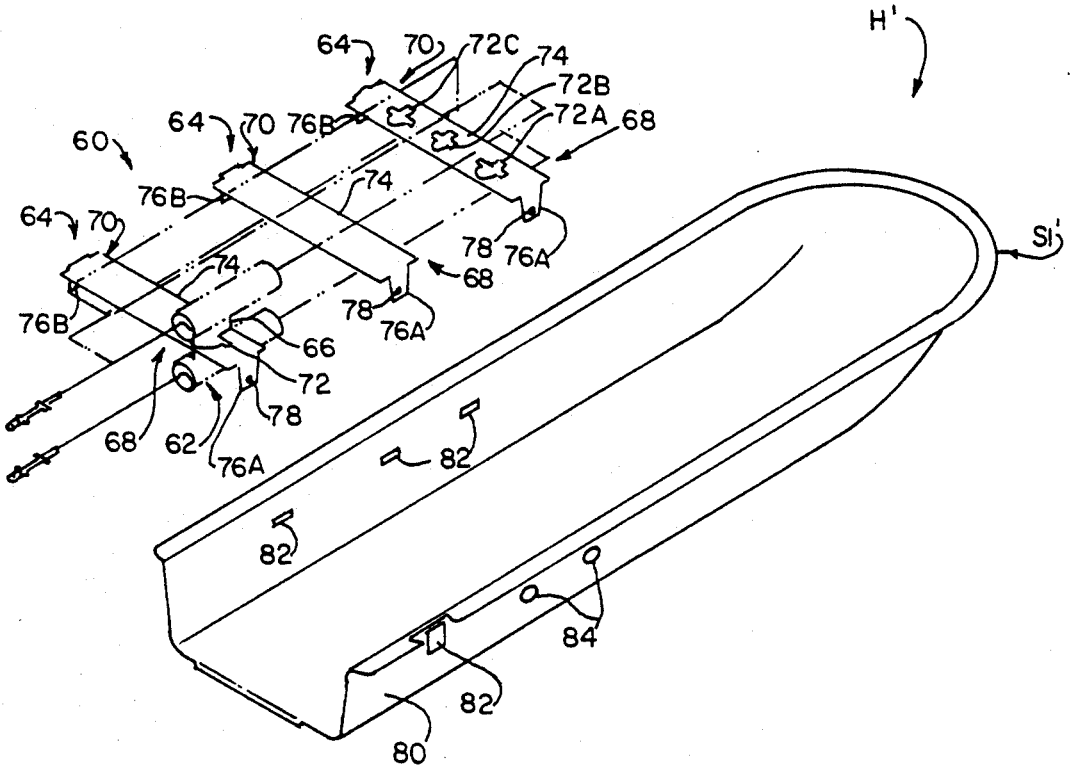
FIG. 9 is a perspective view of an alternate embodiment of the heater assembly.
Figure 13:
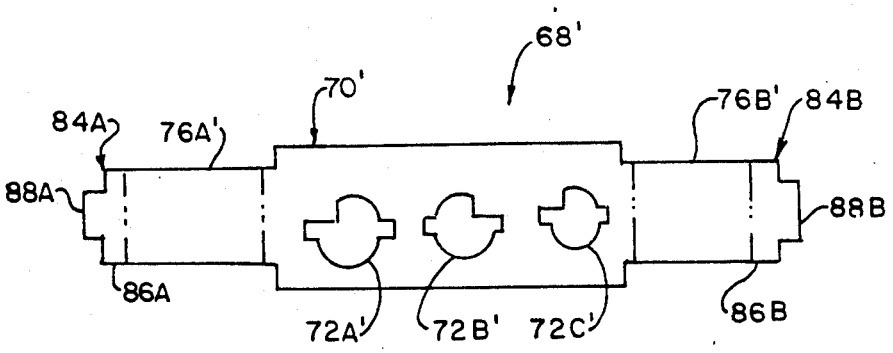

Referring now to FIGS. 9–13, alternate embodiments of the heater assembly are shown. With respect to FIG. 9, section S1, of a heating unit H' has a deeper pan than the other section of the heater (not shown). A heater assembly 60 is directly installable into section S1' adjacent the open end of this section. Assembly 60 first includes an least one open coil heating element 62. The coil is extends longitudinally of the heating unit when the heater assembly is installed in section S1'. An insulator assembly 64 (three of which are shown in FIG. 9) includes a plurality of insulators 66 mounted, in a spaced relationship, on a support member 68. It will be understood that more or fewer insulator assemblies could be used. Again, various types of insulators, such as those shown in FIGS. 7A and 7B, could be used with the insulator assemblies. The support 68 shown in FIG. 9 includes a flat, metal plate 70 in which spaced openings 72 are formed. The openings are identical to the openings 24A–24C described with respect to support 22 of the previous embodiment. The insulators are installed on the support in the manner previously described, and separate convolutions of coil 62 are fitted in the respective notches formed in the insulators. With three insulators mounted on the respective plates 70, the heater assembly will have three courses extending both above and below the plates. Again, more or fewer insulators could be mounted on each plate, and the number of courses would change accordingly.

In FIG. 9, the plates 70 are shown to have a flat, central section 74 in which the openings 72 are formed, and downwardly turned side pieces 76A, 76B which are narrower in width than section 74. The side pieces taper in width from their end joining section 74 to their distal period. Each side piece also has an opening 78 in their distal end for attaching the insulator assembly to a sidewall 80 of section S1'. The overall width of the insulator assemblies corresponding to the inner width of section S1', for the insulator assemblies to fit within the section. Attachment of the insulator assemblies to the sidewall can be performed in any convenient manner. For example, the sidewall can have openings 82 corresponding to the openings 78 in the side pieces. A screw, bolt, or other fastener can then be used to attach the insulator assembly to the sidewall. Or, the side pieces can be welded to the inner face of the sidewalls.

Figure 10:
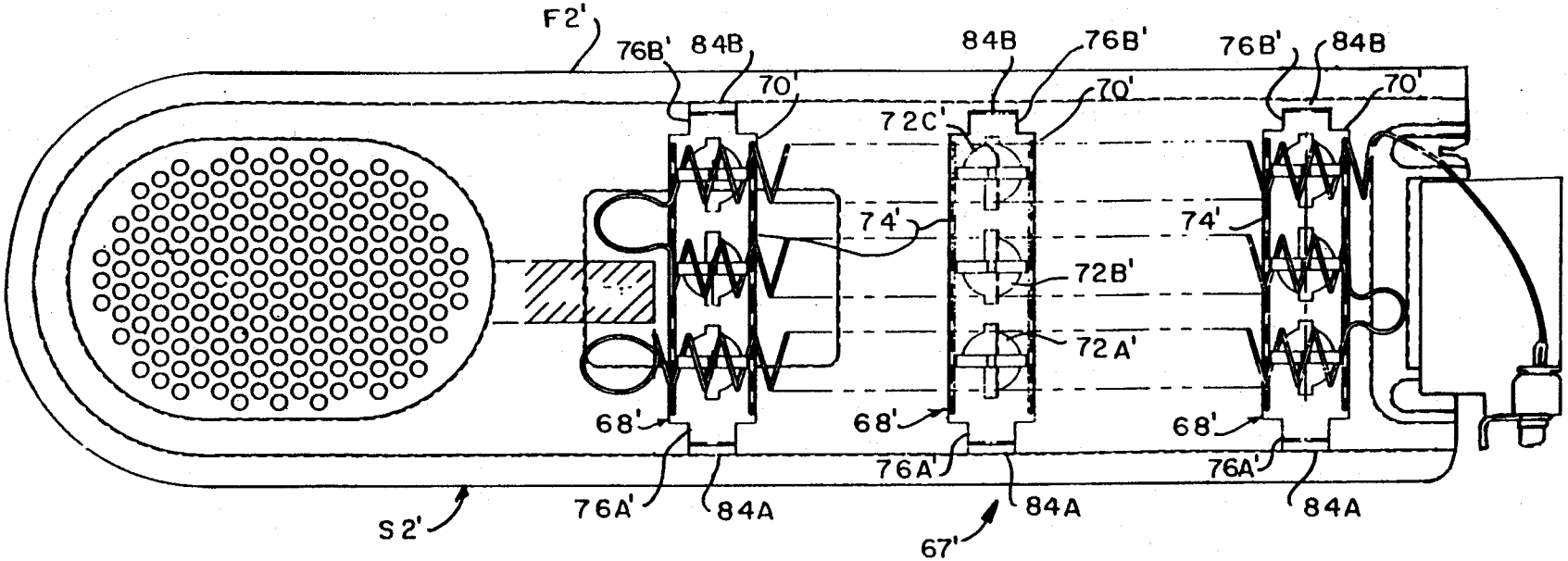
FIGS. 10 and 11 are respective plan and elevational views of a shallow pan heating unit section with a heater assembly installed.
Figure 11:
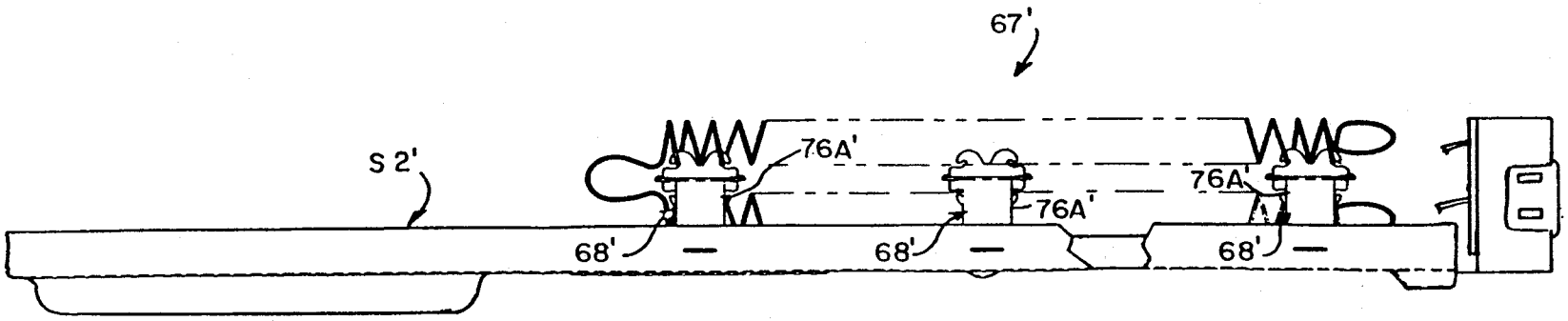

As an alternative to the embodiment of FIG. 9, FIGS. 10 and 11 illustrate a shallow pan section S2' of the heating unit H'. Section S2, has a circumferential flange F2'. A heater assembly 67, is for installation in this heating unit section. Because of the shallowness of the pan, the heater assembly will substantially extend above the sides of the section. This is unlike heater assembly 60 in which generally covered by the sidewalls of section S1'.

Figure 12:
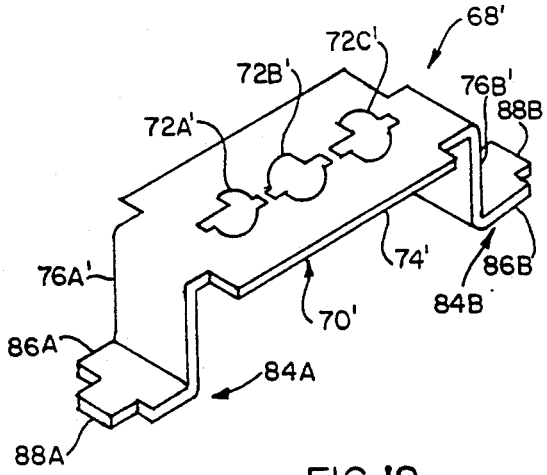
FIG. 12 is a perspective view of another insulator support structure installable in the section of FIGS. 10 and 11; and, FIG. 13 is a plan view Of another support structure installed in the section of FIGS. 10 and 11.

Referring to FIG. 12, the heater assembly 67 is shown to have a support member 68' (three of which are shown in FIGS. 10 and 11). Each member includes a plate 70' having a flat, central section 74, in which openings 72A'–72C' are formed. The plate also has side pieces 76A', 76B' which of narrower in width than section 74'. At the lower end of each side piece is an outwardly turned tab section 84A, 84B respectively. The tab sections each have an inner portion 86A, 86B of the same width as the side pieces, and an outer, narrower width section forming respective tabs 88A, 88B. Openings corresponding to the width and thickness of the tabs are formed in the sidewall of section S1' and the tabs fit into these openings to install the insulator assemblies in place.

Regardless of which support member is used, the heater assembly is installed in section S1' of the heating unit prior to mating of the other section of the heating unit with section S1'. Because the heater assembly is directly installable to section S1', rather than on some other element which is then installed in the heating unit, heater assembly 60 requires fewer parts than previous heater assemblies required, and the heating unit takes less time to assemble than previously.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

Having thus described the invention, what is claimed and desired to be secured by Letters Patent is:

1. In a heating unit for installation in a clothes dryer, the heating unit having a closed end and an open end and a first section extending the length of the unit and a second and mating section extending a portion of the length thereof, a heater assembly at least partially defining the open end portion of the heating unit and connectable to the end of the second section to complete the heating unit, the heater assembly including;

at least one open coil heating element;

a plurality of insulators to each of which at least one convolution of the coil is attached;

support means on which the insulators are mounted in a spaced relation from each other, the insulators and support means together forming an insulator assembly; and, pan means to which the insulator assembly is attached, the pan means includes an open ended pan having sidewalls to which the insulator assembly is attached, and the pan means further being attached to the heating unit to complete the heating unit when so attached, the second section of the heating unit having an edge portion formed at its end adjacent the heater assembly, and the pan having a lip formed at its end adjacent the second section which fits under the edge to attache the heater assembly to the unit.

2. The heater assembly of claim 1 wherein the first section has a circumferential flange extending therearound and the sidewalls of the pan have outwardly turned flanges which abut the flange of the first section when the heater assembly.

3. The heater assembly of claim 2 further including means for connecting the respective flanges together.

4. The heater assembly of claim 1 wherein the dryer has a support for supporting the unit when it is installed, the support being contoured, and the heater assembly has a mating contour to provide an appropriate fit with the support.

5. The heater assembly of claim 4 wherein the support has indentations formed therein, and the pan has a plurality of protruberances matingly fitting in the indentations.

6. In a heating unit for installation in a clothes dryer, one end of the heating unit being a closed end and the other end is open, the heating unit having a first section extending the length of the unit and a second and mating section extending a portion of the length thereof, the improvement comprising a heater assembly connected to the end of the second section to complete the heating unit, the heater assembly comprising an open coil heating element, a plurality of insulators to each of which a convolution of the coil is attached, a support on which the insulators are mounted in a spaced relation from each other, the insulators and support means together forming an insulator assembly, and a pan attached to the second section of the heating unit to complete the unit, the pan being an open ended pan which, when attached to said second section, completes the open end of the unit, the insulator assembly being carried by said pan.

7. The improvement of claim 6 wherein the second section has an edge portion formed at its end adjacent the heater assembly, and the pan has a lip formed at its end adjacent the second section which fits under the edge to attach the heater assembly to the unit.

8. The improvement of claim 7 wherein the first section has a circumferential flange extending therearound and the pan has sidewalls with outwardly turned flanges which abut the flange of the first section when the heater assembly.

9. The improvement of claim 7 further including means for connecting the respective flanges together.

10. The improvement of claim 8 wherein the insulator assembly is attached to the sidewalls of the pan.

* * * * *